US005879243A

United States Patent [19]

Hackman

[11] Patent Number: 5,879,243

[45] Date of Patent: Mar. 9, 1999

[54] WEIGHT FORWARD GOLF CLUB HEAD

[76] Inventor: Lloyd E. Hackman, 1322 Clubview Blvd. S., Worthington, Ohio 43085

[21] Appl. No.: 905,193

[22] Filed: Aug. 1, 1997

Related U.S. Application Data

[63] Continuation of Ser. No. 604,759, Feb. 23, 1996, abandoned.

[51] Int. Cl.[6] ..... A63B 53/04

[52] U.S. Cl. ..... 473/342; 473/349

[58] Field of Search ..... 473/324, 334, 473/335, 336, 337, 338, 341, 342, 291, 349, 350, 256, 345

[56] References Cited

U.S. PATENT DOCUMENTS

| | | | |
|---|---|---|---|
| 1,355,889 | 10/1920 | Campbell | 473/342 |
| 1,968,092 | 7/1934 | Oldham . | |
| 3,084,940 | 4/1963 | Cissel . | |
| 3,695,618 | 10/1972 | Woolley . | |
| 3,863,932 | 2/1975 | Lezatte . | |
| 4,023,802 | 5/1977 | Jepson . | |
| 4,085,934 | 4/1978 | Churchward . | |
| 4,754,977 | 7/1988 | Sahm | 473/337 |
| 4,883,275 | 11/1989 | Boone . | |
| 4,934,703 | 6/1990 | Delaney | 473/342 |
| 5,028,049 | 7/1991 | McKeighen . | |
| 5,076,585 | 12/1991 | Bouquet . | |
| 5,172,913 | 12/1992 | Bouquet . | |
| 5,190,290 | 3/1993 | Take . | |
| 5,312,106 | 5/1994 | Cook . | |
| 5,423,534 | 6/1995 | Solheim . | |
| 5,423,535 | 6/1995 | Shaw et al. . | |
| 5,431,396 | 7/1995 | Shieh . | |
| 5,433,440 | 7/1995 | Lin . | |
| 5,482,279 | 1/1996 | Antonius . | |
| 5,492,327 | 2/1996 | Biafore . | |
| 5,509,660 | 4/1996 | Elmer . | |
| 5,580,322 | 12/1996 | Bouquet | 473/342 |
| 5,584,770 | 12/1996 | Jensen | 473/350 |

*Primary Examiner*—Sebastiano Passaniti
*Attorney, Agent, or Firm*—Frank H. Foster; Kremblas, Foster, Millard & Pollick

[57] ABSTRACT

A metal wood golf club head having a substantial portion of the mass of the club positioned near the front, striking face of the club head. A high density material, such as tungsten, is inlaid in the face section of the club head. The remaining, rear bulbous section is made of a lightweight, high strength material such as titanium.

20 Claims, 7 Drawing Sheets

FIG-14
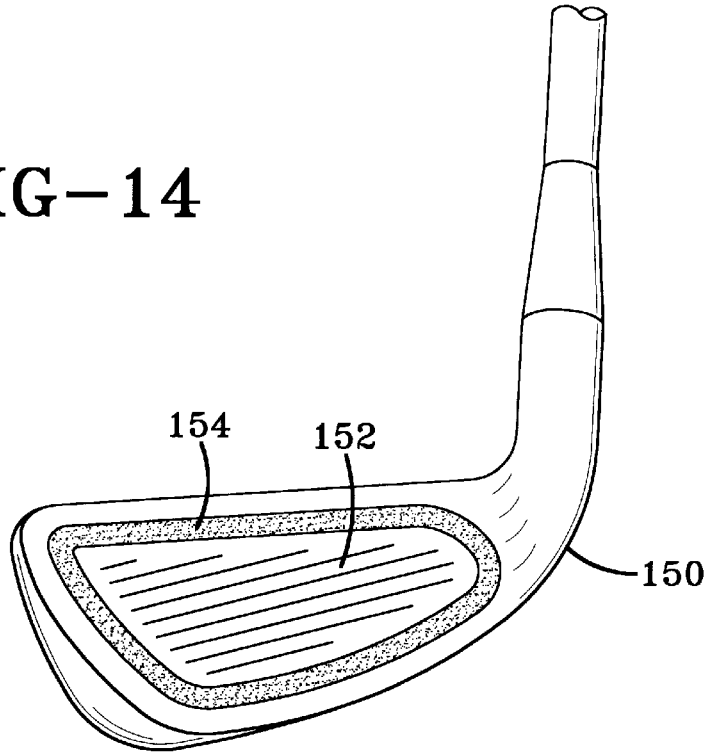
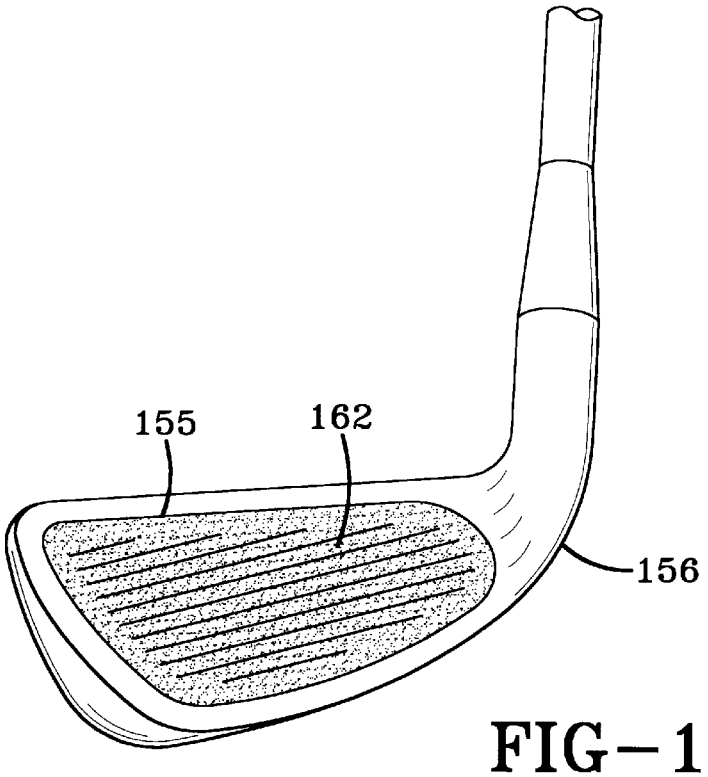
FIG-15

WEIGHT FORWARD GOLF CLUB HEAD

This application is a continuation of application Ser. No. 08/604,759, filed Feb. 23, 1996, now abandoned.

TECHNICAL FIELD

This invention relates generally to the field of golf equipment and specifically relates to golf club head designs.

BACKGROUND ART

A conventional set of golf clubs normally contains a putter, several irons and a few woods. The heads of woods were traditionally made of wood, but more recently have been constructed of steel. A wood made of steel (also called a metal wood) has a similar external configuration to a wooden one, and has a hollow interior chamber to maintain the mass of the metal wood to be similar to a wooden one of the same designation (e.g. 3 wood).

More recently, metal woods have been made of titanium and other lightweight, high strength alloys. The use of these alloys has permitted club head designers to strategically design the heads due to fewer weight limitations in the material used. Titanium has a higher strength-to-weight ratio than steel, and therefore the entire golf club head can be made, for example, much larger than a steel or wooden head of the same designation.

The primary advantage of increasing the size of the club head is the increased size of the striking face of the club head. The striking face is the nearly flat, outer surface of the club head which is intended to impact the golf ball. Although a larger striking face improves the probability of hitting a ball in the desired direction, further improvements can be made to metal woods, whether of normal size or not.

FIG. 1. shows a conventional golf club 10 and its club head 12 swung along a swing path 14. The center of mass (which is denoted CM, and is coincident with the center of gravity) is the point at which the mass of the club head 12 is treated as being concentrated, and the swing path 14 is the line through which the center of mass passes when the club 10 is swung.

It is preferred that, when the striking face 16 impacts the golf ball 18, the plane of the striking face 16 be laterally perpendicular to the swing path 14 if a straight drive (no hook or slice) is desired. Laterally perpendicular means that a line drawn horizontally through the plane of the face 16 is perpendicular to the swing path 14. It is also preferred for a straight drive that the face 16 stay laterally perpendicular through the entire time period that the ball 18 and face 16 are in contact. Normally, some angle will be formed between the face 16 and swing path 14, but it is desirable to minimize this angle. When the face 16 strikes the ball 18, it compresses the ball 18, storing up energy which is released when the ball 18 expands and leaves the face 16. The more the face 16 remains laterally perpendicular until after the ball 18 leaves it, the less sideways spin (which causes hooks and slices) will be imparted to the ball 18.

Even if the swing path 14 starts laterally perpendicular to the striking face 16, if the point of impact with the ball 18 is not positioned along the swing path 14, the ball 18 will most probably not be projected away from the striking face 16 along a laterally straight line. Problems arise when the point of ball 18 impact is offset from the swing path because this may cause the face 16 to become laterally angled relative to the swing path 14 even if it is laterally perpendicular at the instant of impact. The changing of the angle between the face 16 and the swing path 14 is described in the following paragraphs.

FIG. 2 shows the golf club 12 swung along the same swing path 14 as in FIG. 1. The ball 18, however, impacts the striking face 16 at a point which is offset from the swing path 14 by the distance $a_2$. At the instant the club striking face 16 contacts the ball 18 it exerts a force against the ball 18, and the ball 18 exerts an equal and opposite force against the club head 12. Since the force exerted by the ball 18 is applied to the club head 12 a distance $a_2$ from its center of mass, the force causes a torque $\Gamma$ to be applied to the club head 12. The distance $a_2$ is the moment arm of the torque $\Gamma$ (torque, $\Gamma$ equals the force, F times the moment arm, $a_2$) applied to the club head 12. The torque $\Gamma$ causes the club head 12 to rotate about the point of impact between the ball 18 and the striking face 16, making the club head 12 an unstable body.

The rotation of the club head 12 about the point of impact with the ball 18 causes the striking face 16 to become laterally angled relative to the swing path 14 during the brief time period of ball impact. From the moment of initial impact of the ball 18 with the striking face 16, through compression and then expansion of the ball 18 until release of the ball 18 from the striking face 16, the lateral angle of the striking face 16 relative to the swing path 14 will change due to the torque $\Gamma$ applied to the club head 12. Even if the face 16 is laterally perpendicular to the swing path 14 at the beginning of ball 18 impact, the torque applied to the club head 12 will rotate the club head 12, forming an angle between the face 16 and the swing path 14. The angled face 16 will cause sideways spin on the ball 18 making the ball 18 spin and therefore veer to one side or the other.

Increasing the club head size does not decrease the above-described torque. Increasing the club head size primarily increases the striking face size, thereby increasing the likelihood of hitting a golf ball with the better part of the striking face. However, since the striking face is so much larger on a larger club head than a conventional golf club head, the torque due to offset ball impact is potentially greater since the point of impact with the ball can be offset substantially farther from the center of mass, creating a substantially longer moment arm.

Therefore, the need exists for an improved golf club head which reduces or eliminates the torque applied to a golf club head due to misalignment of the ball with the swing path.

BRIEF DISCLOSURE OF INVENTION

The invention is an improved golf club head having a bulbous rear section, which is made of a material having a predetermined density, and an opposite face section. The improvement comprises forming at least a portion of the face section of a material having a density greater than the material of the rear section.

By having material of a greater density in the face section, a portion of the weight of the club head which may have been in the rear section of a conventional club head is located at the face section, thereby positioning the center of mass nearer the face of the club, unlike the conventional position of the center of mass in the central region of the club head. By positioning the center of mass at or near the face section, the torque applied to the club head resulting from impact with a golf ball is limited substantially and the change of the moment arm with rotation is minimal.

BRIEF DESCRIPTION OF DRAWINGS

FIG. 14 is a view in perspective of an iron club head; and

FIG. 15 is a view in perspective of an iron club head.

Figure 1:
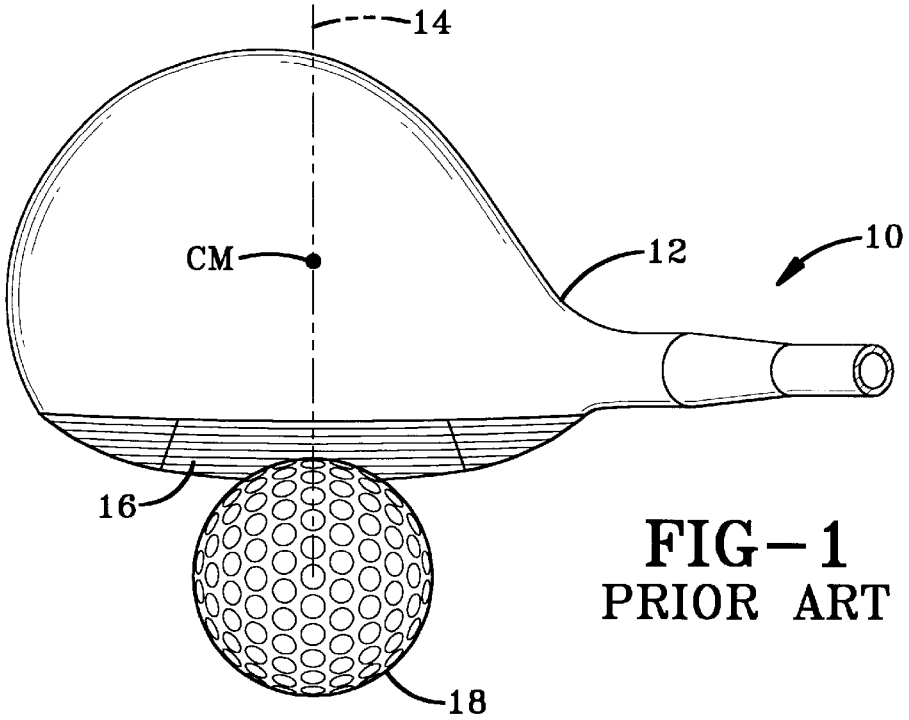
FIG-1 PRIOR ART
FIG. 1 is a top view illustrating a prior art golf club at the point of impact with a golf ball.
Figure 2:
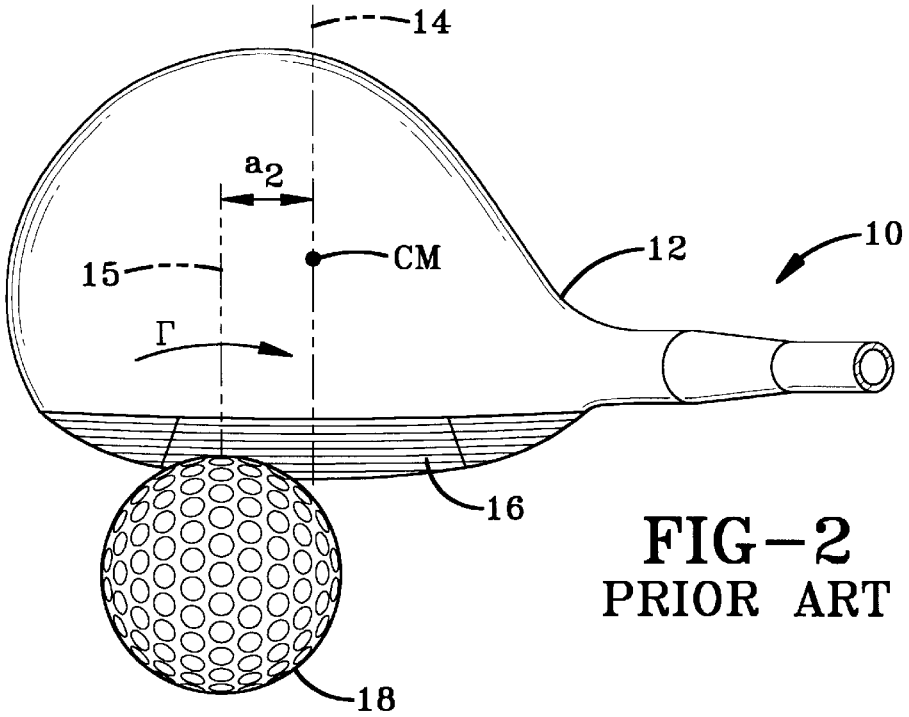
FIG-2 PRIOR ART
FIG. 2 is a top view illustrating a prior art golf club at the point of impact with a golf ball.
Figure 3:
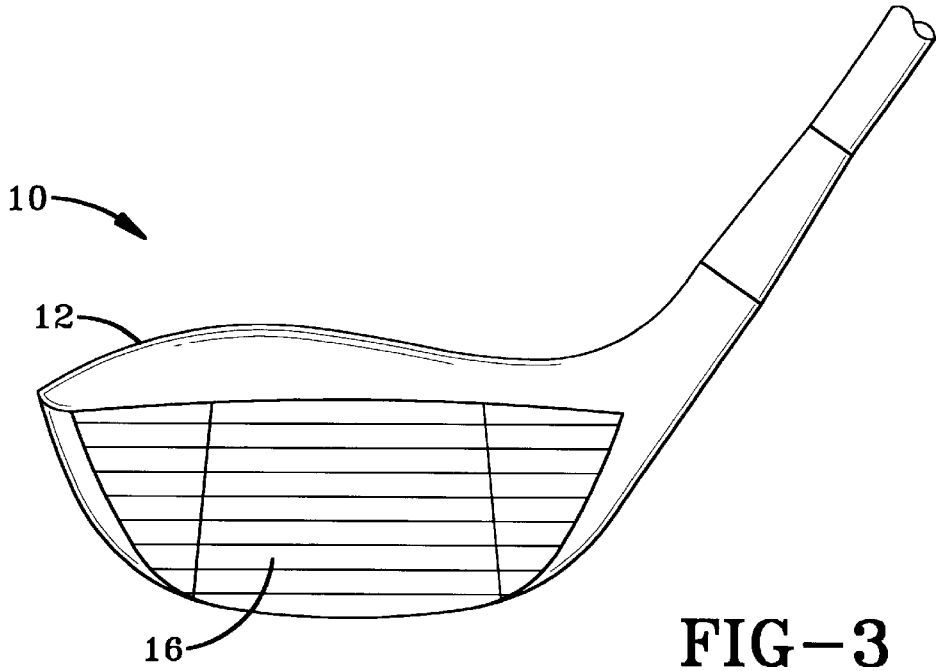
FIG-3 PRIOR ART
FIG. 3 is a side view illustrating a conventional golf club head.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

Figure 4:
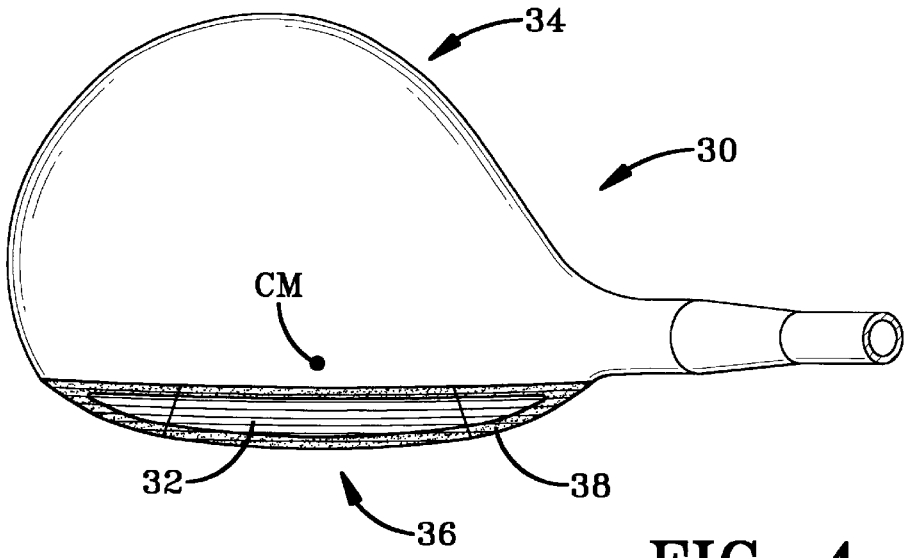
FIG. 4 is a top view of the preferred embodiment of the present invention.
Figure 5:
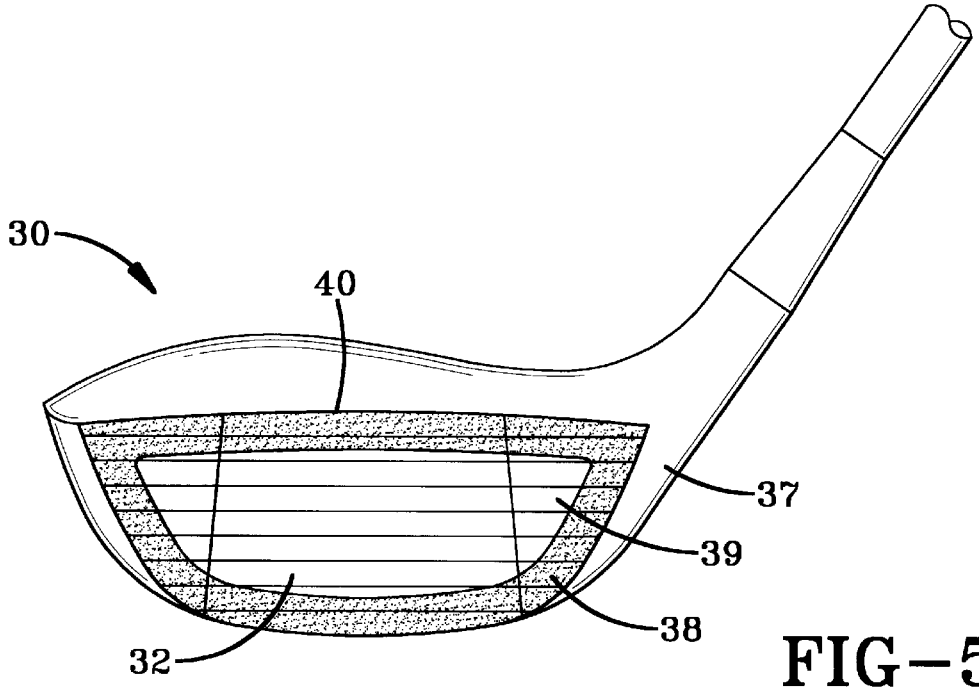
FIG. 5 is a side view of the preferred embodiment of the present invention.
Figure 6:
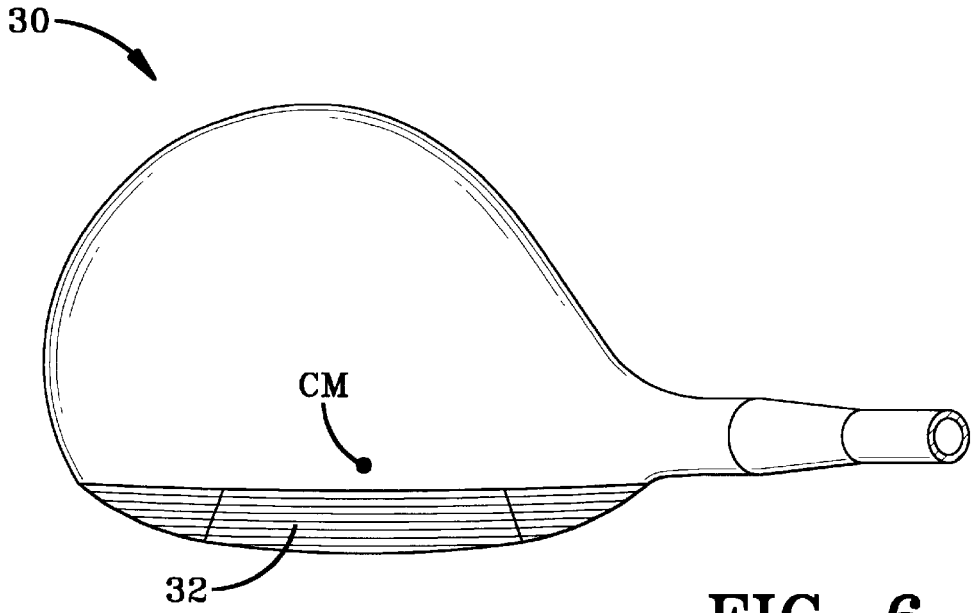
FIG. 6 is a top view of the preferred embodiment of the present invention.

The preferred embodiment of the present invention is illustrated in FIGS. 4 and 5, which show a golf club head 30 having conventional shape, dimensions and overall weight. Although the overall weight is conventional, the club head 30 has a greater portion of its weight near the striking face 32 than a conventional club head, which positions the center of mass near the front of the club head 30. This part of the club head 30 is very different from conventional club heads.

The club head 30 has a bulbous rear section 34 which protrudes rearwardly and oppositely from a frontally located face section 36. The face section 36 includes the striking face 32 and a region around the face 32 extending from the frontward most portion of the face 32 toward the rearward most portion of the rear section 34, terminating at a point in between. The face section extends preferably not more than one-tenth of this distance, and would not exceed one-quarter this distance.

The bulbous rear section 34 conventionally exists only on woods such as drivers, but not other club types such as irons or putters. Irons typically have an angled striking face and an angled rear surface contour which roughly matches the angled striking face. Therefore, irons do not have the bulbous rear section 34 of a wood.

The rear section 34 of the club head 30 is preferably made of titanium, but could also be made of another lightweight, high-strength alloy such as an aluminum beryllium or magnesium. The rear section 34 could also be made of graphite or another lightweight, strong, non-metallic material or a composite of multiple materials.

The club head 30 has a chamber formed inside the rear section 34 which is similar to conventional steel club heads. The sidewalls of the club head 30 around the chamber are of similar thickness to a conventional steel club head, but since the sidewalls are made of a much lighter material, the rear section 34 is substantially lighter than the same section of a conventional metal wood made of steel or wood. This makes the total mass of the club head 30 the same as a conventional club, which means the face section 36 can be heavier than the equivalent part of a conventional wooden or metal wood club head.

The center of mass of the club head 30 is near the striking face 32, since a part of the face section 36 is made of a higher density material than the rear section 34. Preferably this higher density material is a metal such as tungsten. This structure is constructed in the preferred embodiment by inlaying a tungsten band 38 into the face section 36, flush with the normal outer surface 37 of the club head 30. The band 38 extends inwardly approximately three-eighths of an inch from the conventional shoulder 40 formed around the planar front surface 39, of which the striking face 32 is a part. The depth of the tungsten band 38 is approximately one-eighth of an inch, but of course would vary depending upon the total mass desired, the mass of the rear section 34 and the material used. The width, thickness and shape of the band could be varied from the preferred embodiment as will be apparent to those of ordinary skill once the present invention is understood. In the preferred embodiment, the band comprises 70% to 75% of the club head weight.

A portion of the face section 36 is described as having "higher density" than the rear section 34. The term "higher density" is meant to include all densities exceeding the density of the rear section 34 material by a significant amount. A density of one material which exceeds another by 1% or less would not be considered significant, but an excess of 25% or greater would be. Between these two extremes is a spectrum of magnitudes of excess, some of which would be considered significant and others which would not, depending on the circumstances. Of course, as the amount of excess increases, the probability of its significance increases.

Figure 11:
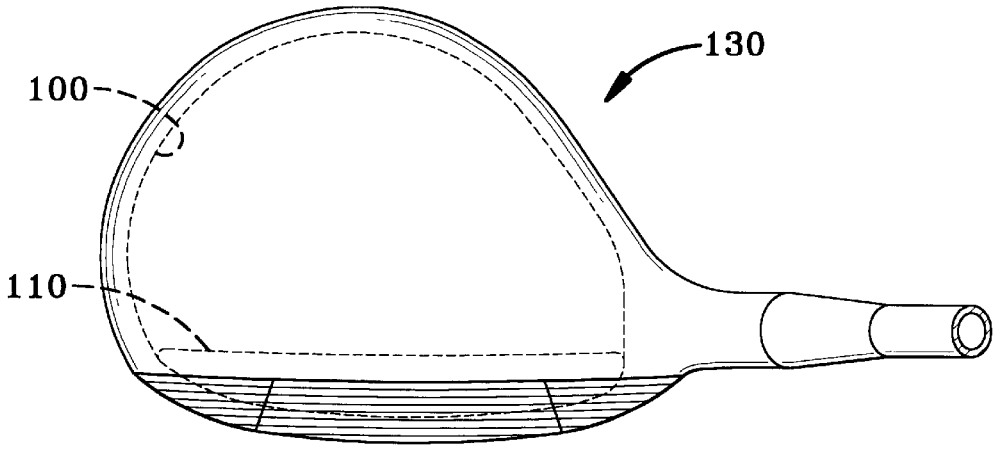
FIG. 11 is a top view of a golf club having a chamber formed within it.

Although the periphery of the striking face 32 is the preferred location for the higher density material portion of the face section 36, the higher density portion could be positioned elsewhere. For example, the entire striking face 32 could be made of tungsten or another high density material. Additionally, both the striking face 32 and the band 38 surrounding the striking face 32 could be made of tungsten or another high density material. Also, the higher density material could be formed into a body, such as the wall or platform 110 (shown in hidden lines in FIG. 11), and mounted within the forward portion of the chamber 100 (shown in hidden lines) formed inside the club head 130.

Figure 8:
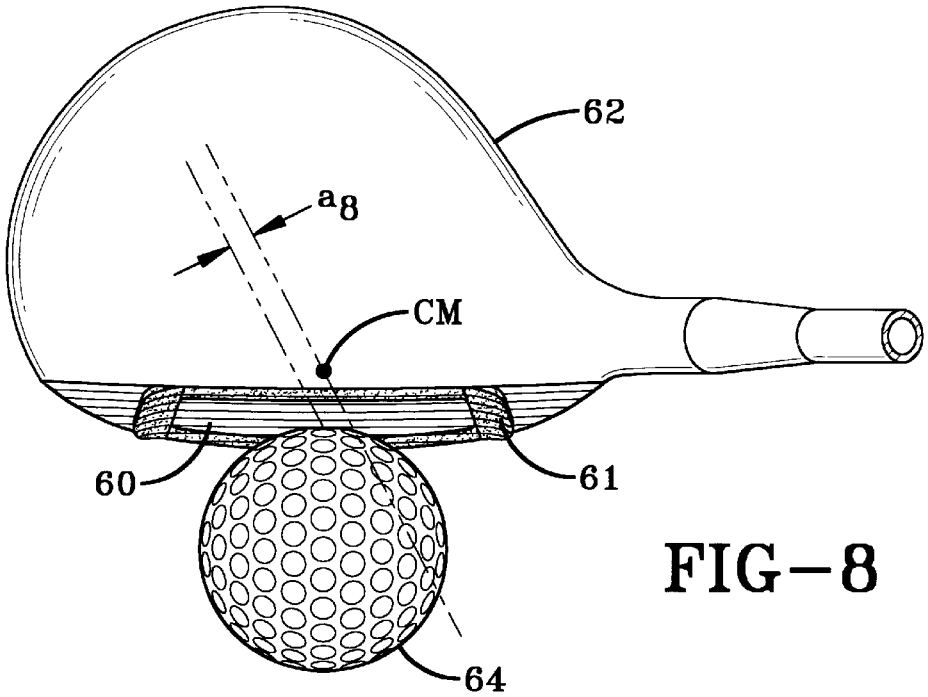
FIG. 8 is a top view of an embodiment of the present invention.

Instead of making the tungsten band similar to the tungsten band 38 which is flush with the normal outer surface 37 of the club head 30, a band 61 as shown in FIG. 8 could be constructed, a portion of which extends forwardly of the normal outer surface 37 of the golf club 62. This band 61 extends the center of mass even farther forward in the golf club head 62 than merely constructing a band which is flush with the outer surface 37.

The result of making a portion of the face section 36 of a higher density material than the rear section 34 is the positioning of the center of mass (denoted by the abbreviation CM) more toward the face section 36 than in its normal central location in a conventional club head. The rear section 34 is lighter than the equivalent portion of a steel club head, and the weight which normally would be in the rear section is positioned in the invention as far forward, near the striking face 32, as possible. This positioning of more weight near the front "shifts" the center of mass nearer the front of the club head 30, making the club head 30 more stable. The benefit of positioning the center of mass near the front of the club head 30 is stability during striking of a golf ball; stability which gives decreased torque forces due to a decrease in moment arm length in most cases. The torque forces otherwise tend to increasingly angle the striking face 32 which is an unstable condition.

The benefit of positioning the center of mass close to the striking face 32 is not realized when the golf club 30 is swung perfectly: along a swing path laterally perpendicular to the striking face 32 and with the point of impact between the golf ball and face 32 along the swing path. There is no moment arm in this case and without a moment arm there can be no torque. Since no torque exists (no torque of the type described above) when the point of ball impact lies along the laterally perpendicular swing path, positioning the center of mass closer to the club face 32 makes no improvement.

Therefore, moving the center of mass toward the striking face 32 only reduces torque on the club head 30 when the ball is struck imperfectly: (1) when the point of impact is offset from the swing path, (2) when the swing path is not laterally perpendicular to the striking face 32 and (3) a combination of these two. In these cases, and any other in which a torque is applied to the club head due to ball impact, the invention provides a club head which reacts better to an imperfectly struck ball than prior art club heads. Stated simply, a golf club head constructed according to the present invention rotates less than prior art club heads. This reduced rotation is due to a reduced torque, which arises from the reduced moment arm. Therefore, the ball travels straighter (i.e. less hook or slice) after it leaves the club head.

Figure 7:
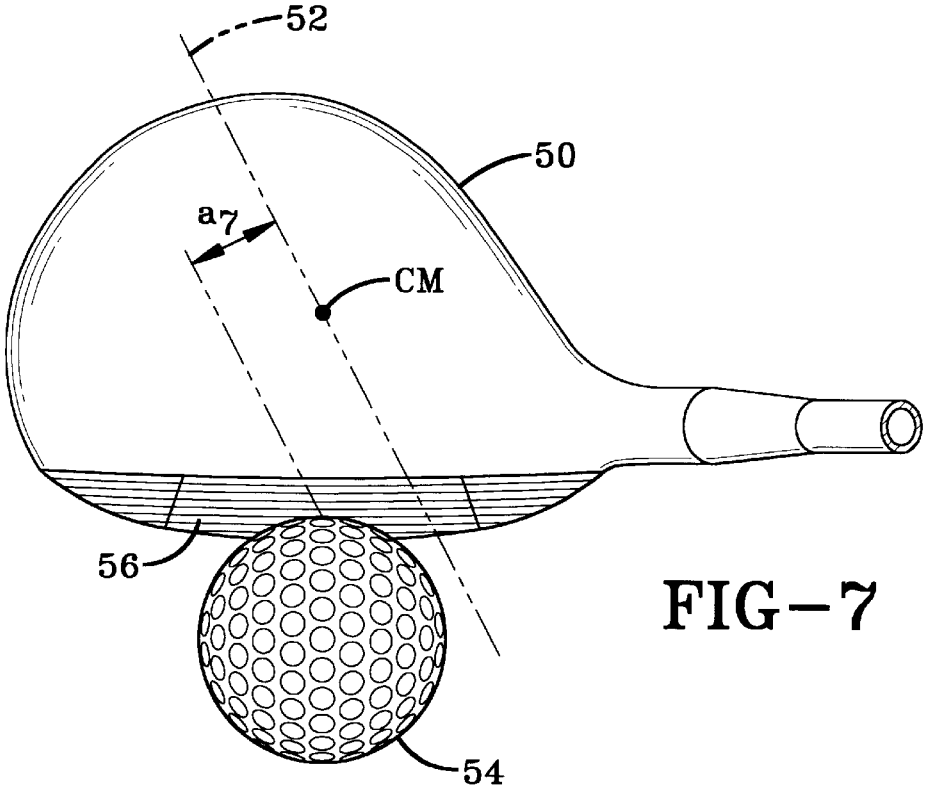
FIG. 7 is a top view of a conventional golf club.

FIGS. 7 and 8 illustrate one of the two types of imperfect impacts. The conventional golf club 50 shown in FIG. 7 is swung through a path 52 and the striking face 56 is at an angle (laterally) relative to the swing path 52. The angle is exaggerated in order to more clearly illustrate the principles. This is an undesirable approach to the ball for a non-expert, but is nonetheless common. The ball 54 has a point of impact at the center of the striking face 56 (which is correct, but impact offset from this, combined with this angled approach, can make the error even greater). A moment arm $a_7$ has a length equal to the distance of a perpendicular line between the point of impact and the swing path 52. There is a striking force applied by the club head 50 to the ball 54 (and therefore an equal and opposite striking force applied to the club head 50 by the ball 54) which generates a clockwise torque on the club head 50. This torque rotates the striking face 52, causing it to become angled. This causes the ball 54 to curve in a sideways direction (i.e. hook or slice) due to spin imparted to the ball 54.

In FIG. 8, the center of mass is positioned according to the present invention, and all other parameters are similar to the club head 50 of FIG. 7. A substantially smaller moment arm $a_8$ will exist upon impact with the ball 64. Therefore, the torque applied to the club head 62 will be smaller than that applied to the club head 50, since the same force applied to both the conventional club head 50 and the club head 62 embodying the present invention has a smaller moment arm with the club head 62 of the present invention. This will cause less rotation of the club head 62 than the conventional club head 50 making the club head 62 more stable.

Some "corrective" rotation may be desirable in the case of a flawed approach, and a conventional club head may give this some of the time. However, an overall reduction of the torque on, and the resulting rotation of, the club head 62 of the present invention will result in more consistent drives, thereby aiding in improving the golf swing results. Overall improved consistency is preferred over the occasional help/occasional harm of conventional club heads.

Figure 9:
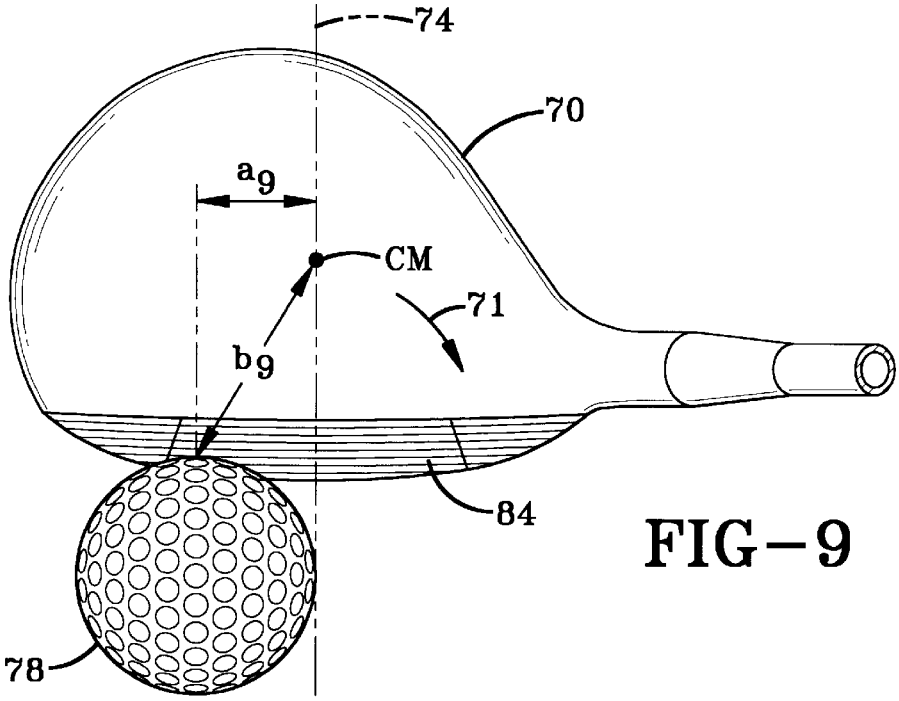
FIG. 9 is a top view of a conventional golf club.
Figure 10:
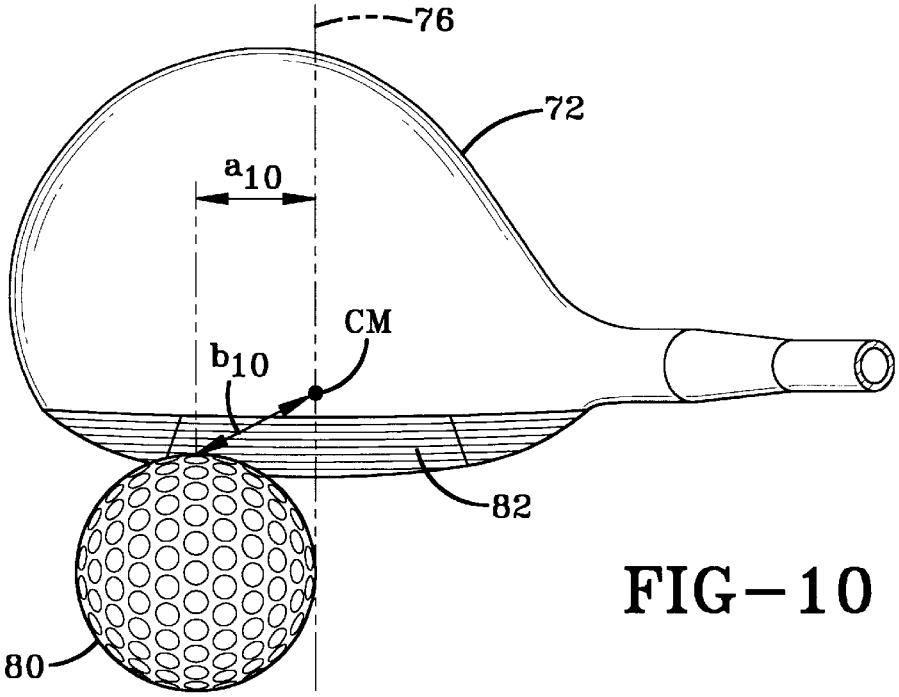
FIG. 10 is a top view of an embodiment of the present invention.

The second of the listed flawed approaches in which the invention limits the harm is when the swing path is substantially perpendicular to the striking face of a club but the ball impact is offset from the swing path. FIGS. 9 and 10 show two golf club heads 70 and 72 having two swing paths 74 and 76, respectively. The club head 70 impacts the ball 78 and the club head 72 impacts the ball 80. The primary difference between the club heads 70 and 72 is that the club head 72 embodies the present invention, which is why the center of mass is very near the striking face 82. The center of mass of the club head 70 is centrally located as in conventional golf club heads.

Upon impact between the conventional club head 70 and the ball 78, a torque is applied to the club head 70 which is a function of the moment arm $a_9$. As the club head 70 rotates under the influence of this torque, the moment arm of the force applied by the ball 78 increases in length over time, as the center of mass becomes a greater distance from the line drawn through the point of impact, potentially to a theoretical maximum of $b_9$. This increase in moment arm over time thereby increases the torque over time making the system unstable as long as the ball or load is on the club face. Since the torque causes rotation, and the rotation increases the torque (by increasing the moment arm), the rotation increase becomes accelerated and unstable. The torque will increase up to a maximum when the moment arm $b_9$ becomes perpendicular to the swing path 74 and will then decrease.

Figure 12:
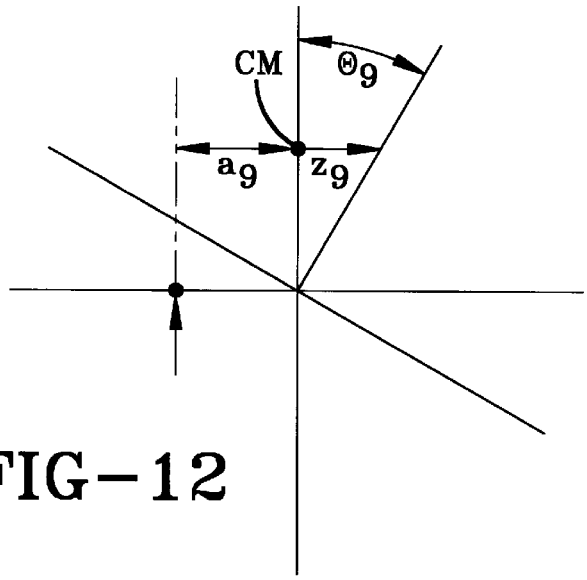
FIG. 12 is a diagrammatic illustration showing the rotation of a golf club face.

The increase in moment arm which occurs as the conventional club head 70 rotates, is illustrated diagrammatically in FIG. 12. The initial moment arm $a_9$, upon rotation through an angle $\theta_9$, increases by the segment $z_9$. The segment $z_9$ represents the increase in moment arm from the point of ball impact until rotation through an angle $\theta_9$. This increase is greater than that for the present invention as described below.

The club head 72, embodying the present invention and shown in FIG. 10, will initially experience an identical torque as the conventional club head 70, but only at the instant of impact. This identical torque is due to the fact that at impact the moment arm $a_{10}$, is equal to the moment arm $a_9$, and the applied forces are identical. However, since the center of mass in the club head 72 is so close to the striking face 82, rotation of the club head 72 will cause only a small increase in the moment arm. Since the moment arm increases very little (to a maximum of $b_{10}$ which is substantially less than $b_9$), the torque applied to the club head 72 will increase very little to its maximum (where the moment arm is $b_{10}$) and will increase in magnitude more slowly than the conventional club head 70. Additionally, once maximum torque occurs, the club head 72 will then experience a decreasing torque upon further rotation of the club head 72. This is because once the club head 72 begins to rotate beyond the point where $b_{10}$ is the moment arm, the moment arm will begin to decrease, thereby reducing the torque and creating a more stable condition.

Figure 13:
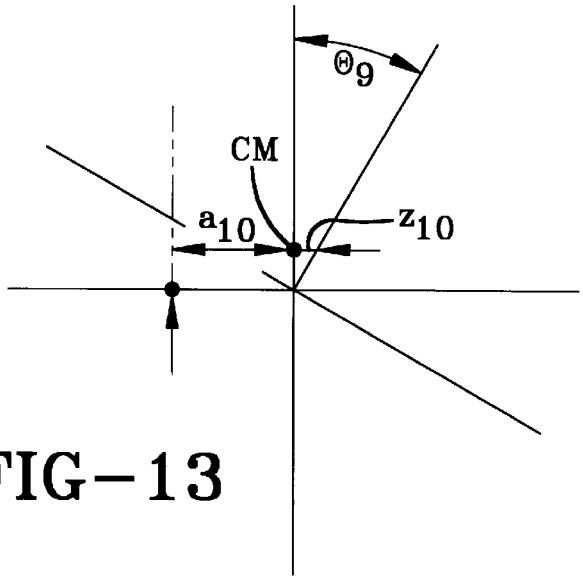
FIG. 13 is a diagrammatic illustration showing the rotation of a golf club face.

The increase in moment arm with the preferred club head 72 is illustrated diagrammatically in FIG. 13. The initial moment arm $a_{10}$ (which is equal to the conventional club's initial moment arm $a_9$), upon rotation of the club head 72 through an angle $\theta_9$, increases by the segment $z_{10}$. It will be noticed that although the club head 72 rotates through the same angle $\theta_9$ in FIG. 13, as in FIG. 12, the increase $z_{10}$ is substantially less than the increase $z_9$. This is due to the center of mass (denoted CM) being positioned nearer the club face 82 in the club head 72 of the invention than in the conventional club head 70.

Therefore, with the preferred invention and under the circumstances illustrated in FIG. 10, the golf club head 72 embodying the invention will experience a slightly increased and then a decreased torque (very little instability), whereas the conventional head 70 will experience a more rapidly increasing torque which increases to a higher maximum (greatly increased instability).

The reason that the moment arm of the force applied to the conventional club head 70 increases much more rapidly than the moment arm applied to the club head 72 of the invention can be explained using the analogy of a rotating hand on a clock. As the clock hand nears the top or bottom of its rotation, its change in height varies only a small amount for a given angle of rotation. However, at the 9 o'clock or the 3 o'clock positions, the same angle of rotation will cause a far greater height displacement of the hand. This is because the slope of the circle formed by the tip of the hand is infinite at the 9 o'clock and 3 o'clock positions and is zero at the 12 o'clock and 6 o'clock positions.

Since the maximum displacement which concerns a golfer is lengthening of the moment arm (lateral widening of the clock between the 9 and 3 o'clock positions), the infinite slope in the golf club head is at 6 and 12 o'clock with zero slope at 3 and 9 o'clock. In the conventional club head 70, the maximum moment arm, $b_9$, is at approximately the 1 o'clock position which is near maximum slope: a small change in rotation means a large increase in the moment arm. However, the maximum moment arm $b_{10}$ of the club head 72 embodying the invention is at approximately the 2 o'clock or 2:30 position which is close to zero slope: a small change in rotation means a very small increase in the moment arm.

When the center of mass is positioned close to the striking surface of a given golf club head, the slope of the moment arm at initial impact is decreased, thereby decreasing the change in length of the moment arm associated with a specified degree of rotation. Therefore, the closer to the striking surface the center of mass can be positioned, the slower the increase in moment arm length will be for a given angle of rotation.

In the present invention, the center of mass is as close to the striking face 82 as possible, which means the moment arm at the instant of impact begins near its maximum. On the contrary, in the prior art golf club head 70, the center of mass is positioned substantially rearward of the striking face 84, and the moment arm at the instant of impact is near its minimum. Because of this, the moment arm has a greater slope, which causes a greater rate of change of the moment arm for a given angle of rotation. Therefore, for a similar rotation of, for example 10 degrees, the conventional club head 70 will have a greater increase in the moment arm than in the golf club head 72 embodying the present invention.

In addition to wood club heads, the present invention is applicable to irons, such as the iron 150 shown in FIG. 14. The iron 150 has a striking face 152 on its frontal surface. A band 154 of high density material, such as tungsten, is inserted around the striking face 152, similarly to the band 38 shown in FIG. 5. The inserted band 154 also functions similarly to the band 38 of FIG. 5, since the band 154 is of a higher density material than that of which the rest of the club 150 is made. This band 154 positions the center of mass closer to the striking face 152, thereby making the golf club head 150 more stable. Instead of the band 154, a tungsten plate 155, such as the one shown in FIG. 15 in the club head 156, could be used. The plate 155 would be flush with the outer surface of the striking face 162 and attached to a central groove formed in the striking face 162.

While certain preferred embodiments of the present invention have been disclosed in detail, it is to be understood that various modifications may be adopted without departing from the spirit of the invention or scope of the following claims.

I claim:

1. An improved golf club head having a bulbous rear section, made of a synthetic material having a predetermine density, and the club head having an opposite face section including a first portion and a second portion, wherein the improvement comprises the second portion being made of a synthetic material having a density greater than the material of any part of the rear section and greater than a density of a synthetic material of the first portion of the face section, the second portion extending rearwardly at least from substantially a striking face plane.

2. A golf club head in accordance with claim 1, wherein the first portion of the face section is made of the same material as the rear section.

3. A golf club head in accordance with claim 1, wherein the second portion of the face section comprises the striking face.

4. A golf club head in accordance with claim 1, wherein the second portion of the face section comprises a band surrounding at least a portion of the striking face.

5. A golf club head in accordance with claim 2, wherein the second portion of the face section comprises a body mounted within a chamber formed in the club head.

6. A golf club head in accordance with claim 1, wherein the second portion of the face section further comprises the striking face and a band surrounding at least part of the striking face.

7. A golf club head in accordance with claim 2, wherein the material having greater density is metal.

8. A golf club head in accordance with claim 7, wherein the material of which the rear section is made is metal.

9. A golf club head in accordance with claim 7, wherein the metal is tungsten.

10. A golf club head in accordance with claim 1, wherein the synthetic material of the rear section, the synthetic material of the first portion of the face section, and the synthetic material of the second portion of the face section are metals.

11. A golf club head in accordance with claim 1, wherein the synthetic material of the rear section, the synthetic material of the first portion of the face section, and the synthetic material of the second portion of the face section are composites.

12. A golf club head in accordance with claim 1, wherein the synthetic material of the rear section, the synthetic material of the first portion of the face section, and the synthetic material of the second portion of the face section are made of metals and composites.

13. A golf club head having a front to rear thickness and a striking face including a first face portion and a second face portion, the club head also having a rear portion made of a synthetic material having a predetermined density, the rear portion including at least a rearwardmost three-quarters of the club head thickness, wherein a synthetic material of the first face portion has a predetermined density, and a synthetic material of the second face portion has a density greater than the material of the first face portion, and greater than the material of any part of the rear portion.

14. An improved golf club head in accordance with claim 13 wherein the second face portion comprises a band of greater density material attached within a groove formed around a peripheral edge of the striking face.

15. An improved golf club head in accordance with claim 13 wherein the second face portion comprises a plate of greater density material attached within a groove formed in a central region of the striking face.

16. An improved golf club head in accordance with claim 13 wherein the material of the second face portion is a metal.

17. An improved golf club head in accordance with claim 16 wherein the metal is tungsten.

18. A golf club head in accordance with claim 13, wherein the synthetic material of the rear section, the synthetic material of the first face portion, and the synthetic material of the second face portion are metals.

19. A golf club head in accordance with claim 13, wherein the synthetic material of the rear section, the synthetic material of the first face portion, and the synthetic material of the second face portion are composites.

20. A golf club head in accordance with claim 13, wherein the synthetic material of the rear section, the synthetic material of the first face portion, and the synthetic material of the second face portion are made of metals and composites.

* * * * *